US006880176B2

(12) United States Patent
Timms et al.

(10) Patent No.: US 6,880,176 B2
(45) Date of Patent: Apr. 19, 2005

(54) HEADGEAR

(75) Inventors: Richard M. Timms, Del Mar, CA (US); Michael J. Yokota, San Diego, CA (US); John W. Montello, El Cajon, CA (US)

(73) Assignee: Troxel Cycling & Fitness LLC, San Diego, CA (US)

( * ) Notice: Subject to any disclaimer, the term of this patent is extended or adjusted under 35 U.S.C. 154(b) by 0 days.

(21) Appl. No.: 10/035,802

(22) Filed: Nov. 9, 2001

(65) Prior Publication Data

US 2004/0123378 A1 Jul. 1, 2004

Related U.S. Application Data

(63) Continuation of application No. 09/696,644, filed on Oct. 25, 2000, now Pat. No. 6,317,896.

(51) Int. Cl.[7] ..... A63B 71/10
(52) U.S. Cl. ..... 2/425; 2/171.3; 2/184.5
(58) Field of Search ..... 2/425, 410, 421, 2/417, 418, 419, 420, 416, 183, 171.3, 411, 414, 209.7, 209.5, 412, 184.5

(56) References Cited

U.S. PATENT DOCUMENTS

| | | | | |
|---|---|---|---|---|
| 350,651 A | | 10/1886 | Basch | |
| 432,728 A | | 7/1890 | Eliel | |
| 735,790 A | | 8/1903 | Meerza | |
| 934,508 A | | 9/1909 | Deely | |
| 1,569,181 A | * | 1/1926 | Hartman | 2/414 |
| 1,988,101 A | | 1/1935 | Wittcoff | 2/176 |
| 2,000,540 A | * | 5/1935 | Uhlmann et al. | 2/414 |
| 2,112,383 A | | 3/1938 | Sloan et al. | 2/182 |
| 3,329,968 A | | 7/1967 | Gordon | |
| 3,706,101 A | | 12/1972 | Plastino | |
| 3,790,962 A | | 2/1974 | Plastino | 2/3 R |
| 4,051,555 A | | 10/1977 | Daly | |
| 4,345,336 A | | 8/1982 | Plastino | 2/187 |
| 4,434,514 A | * | 3/1984 | Sundahl et al. | 2/425 |
| 5,044,016 A | | 9/1991 | Coombs | |
| 5,113,534 A | | 5/1992 | Lane et al. | 2/416 |
| 5,271,103 A | | 12/1993 | Darnell | |
| 5,345,614 A | * | 9/1994 | Tanaka | 2/425 |
| 5,381,560 A | | 1/1995 | Halstead | 2/421 |
| 5,638,551 A | | 6/1997 | Lallemand | |
| 5,680,656 A | * | 10/1997 | Gath | 2/424 |
| 5,718,004 A | | 2/1998 | Broersma | |
| 5,826,279 A | | 10/1998 | Tencer | |
| 5,898,949 A | | 5/1999 | Barthold et al. | 2/416 |
| 6,032,297 A | | 3/2000 | Barthold et al. | |
| 6,122,773 A | * | 9/2000 | Katz | 2/171.3 |

FOREIGN PATENT DOCUMENTS

| | | |
|---|---|---|
| DE | 3720798 | 1/1989 |
| FR | 865015 | 5/1941 |
| GB | 2201330 | 9/1988 |

* cited by examiner

*Primary Examiner*—Rodney M. Lindsey
(74) *Attorney, Agent, or Firm*—Walter W. Duft

(57) ABSTRACT

An improved headgear includes an outer shell and an inner liner providing a head receiving cavity. A headband has a forward portion and lateral portions secured to the inner liner and a rearward portion extending rearwardly of said lateral portions. A first vent aperture is centrally formed in the outer shell. A second vent aperture is centrally formed in the inner liner. Third vent apertures are formed in the inner liner in spaced relationship with the second vent aperture.

18 Claims, 12 Drawing Sheets

HEADGEAR

CROSS REFERENCE TO RELATED APPLICATIONS

This application is a continuation of application Ser. No. 09/696,644, filed Oct. 25, 2000, entitled "Improved Headgear", now U.S. Pat. No. 6,317,896.

BACKGROUND OF THE INVENTION

The present invention is directed generally to protective headgear, and particularly helmets used for sporting events and recreational activities. Still more particularly, the invention relates to improved headgear for equestrian use.

There are many types of protective headgear that are presently in use for a variety of recreational activities and work-related uses. In order to be effective, such headgear must properly fit a wearer and should be comfortable during use. Relative to fit, experience has shown that headgear should ride on top of the wearer's head with approximately one (1) inch of space between the headgear lower front edge and the wearer's eyes. Headgear that is too small will not be comfortable, and may ride too high on the wearer's head. Headgear that is too large may sit too low on the wearer's head, and may be more likely to slip so as to possibly reduce its protective capabilities.

In the past, headgear manufacturers have had to contend with the fact that human heads come in a variety of shapes and sizes. This has necessitated the production of many different sizes of headgear for each headgear model offered to the public. A protective headgear product typically includes a hard outer shell made from molded plastic and a soft inner liner made from molded foam material. To provide the various sizes required to fit a normal cross-section of headgear wearers, manufacturers have had to use several different mold sets for each production model. As will be appreciated, this increases manufacturing time and expense.

In addition to a protective headgear product's outer shell and inner liner, a retention strap system is usually provided to secure the headgear on a wearer's head. A conventional retention strap system includes a pair of side retention straps that mount to the sides of the headgear and fasten under the wearer's chin. Such straps may require complicated adjustments before the headgear can be properly secured on the wearer's head. Moreover, the side retention straps of the prior art are typically spaced substantially from the wearer's face due to the fact that the width of the headgear shell or liner (to which the side retention straps are attached) is generally several inches wider than the wearer's head. This arrangement does not provide an optimal fit and can be aesthetically unappealing. Many prior art headgear products also feature rear retention straps. These are usually either fixed-length straps designed to extend behind the wearer's ears, or straps that must be adjusted by cumbersome threading adjustment that is difficult to master and maintain.

A further disadvantage of prior art protective headgear is that there is generally no ability to change the vertical position of the headgear on the wearer's head, other than by adjustment of the headband.

Relative to headgear comfort, an important requirement of headgear worn in warm climates is that the headgear interior be properly ventilated. For many headgear products, ventilation can be provided very easily by simply forming air vents in the headgear. For equestrian headgear, and particularly headgear used for English saddle riding competitions, the ventilation problem is more difficult to solve. English saddle riders performing in competitions and show events typically wear an equestrian show hat or cap that conforms to very stringent aesthetic requirements. Many years of tradition dictate that such hats be covered in black velvet and include a forward brim, a decorative top button and a rear ribbon bow of unique appearance. It would not be permissible to simply vent such headgear insofar as visible vents could result in the assessment of points against the rider.

A solution to the equestrian headgear ventilation problem is proposed in commonly assigned U.S. Pat. No. 5,718,004 (the '004 patent), the contents of which are incorporated herein by this reference. In the '004 patent, an equestrian show helmet is disclosed that includes an impact resistant outer helmet shell covered in the traditional black velvet material and a protective inner helmet liner mounted within the helmet shell. A first vent aperture is formed at the top of the helmet shell and a second vent aperture is formed at the top of the helmet liner, below the first vent aperture. A venting device is mounted to cover the first vent aperture on the helmet shell. It is also covered in black velvet material so as to look like the traditional equestrian show hat button.

A disadvantage of the venting arrangement of the '004 patent is that the interior openings of the vent apertures are located within a relatively small area at the top of the headgear. Thus, the vents may not perform as efficiently as they could if they were arranged in some other fashion that would allow fresh air to circulate more freely within the headgear interior.

Accordingly, a need exists in the protective headgear art for protective headgear that overcomes the foregoing disadvantages. What is required in particular is an improved headgear product that fits a wider array of head sizes than conventional headgear, which has an improved retention strap system, and which is vertically adjustable. In addition, a headgear design is required in which ventilation performance is improved.

SUMMARY OF THE INVENTION

In accordance with the foregoing objectives, an improved headgear, which may be advantageously embodied as an equestrian show helmet, is provided. The headgear includes an outer shell that provides a tough, durable exterior surface, and an inner liner nested within the outer shell to provide shock absorption. The outer shell and inner liner each include respective forward, rearward and lateral portions. A headband has a forward portion and lateral portions that are respectively secured to the forward and lateral portions of the inner liner. The headband further includes a pair of flexible members extending rearwardly from the headband lateral portions. The flexible members have free end portions that are mutually interconnected via an adjustable locking mechanism that allows the headband to accommodate heads of many different lengths.

In preferred embodiments of the headgear, the flexible members are straps and the locking mechanism comprises a hook and weave securement arrangement. The headband is preferably made from plastic material and the flexible members are covered by soft fabric material.

In further embodiments of the headgear, a fabric lining has an outside edge portion secured between the outer shell and the inner liner. The fabric lining then wraps around the lower rim of the inner liner, extends into head-receiving cavity, and generally follows the inside wall of the inner liner toward the crown of the inner liner. This portion of the fabric lining is generally dome-shaped and adapted to engage a wearer's head. An adjustable opening at the very top of the fabric lining allows the height of the lining to be varied within the head-receiving cavity, thus facilitating vertical adjustment of the headgear. A drawstring or the like may be used to open and close the fabric lining's adjustable opening.

The fabric lining is also preferably arranged to cover the headband forward and lateral portions, such that they are hidden from view. In that case, the fabric lining will also include a pair of slot openings through which the headband flexible members extend from behind the fabric lining and into the head-receiving cavity. As stated above, the exposed flexible members can be cloth-covered, thus improving the decorative appearance of the headgear. It should also be pointed out that the flexible members can be formed with a downwardly angled bend, such that the free ends thereof extend below the head-receiving cavity. This allows the free ends of the flexible members to be connected low on a wearer's head to help retain the headgear in its proper position.

In still further embodiments of the headgear, the headgear includes a strap retention system having a pair of side retention straps mounted to respective sides of the outer shell and extending downwardly therefrom. The retention system further includes a pair of rear retention straps mounted to respective ones of the side straps and secured to each other using an adjustable securement system comprising a buckle. The sides of the inner liner are preferably formed with channels that receive the side retention straps and allow them to drape down in close proximity to a wearer's temples and cheeks.

In still further embodiments of the headgear, the headgear includes a venting system for cooling the head-receiving cavity. The venting system includes a first vent aperture formed at the top of the outer shell and a second vent aperture formed at top of the inner liner. The first and second vent apertures are in fluid communication with each other to provide a primary pathway for air flow between the head-receiving cavity and ambient air outside of the headgear.

The venting system also includes a plurality of third vent apertures formed near the top of the inner liner and in spaced relationship with the second vent aperture. A plurality of grooves are formed in the outer surface of the inner liner and extend from each of the third vent apertures to the second vent aperture. The third vent apertures are thus in fluid communication with the second vent aperture via the grooves to provide secondary pathways for air flow between the head-receiving cavity and ambient air outside of the headgear.

An outer finial is mounted on an outside surface of the outer shell to cover the first vent aperture. If the headgear is for equestrian use, at least a portion of the outer finial will have a raised button-shaped appearance. The finial has air flow passages that are in fluid communication with the first aperture. An inner escutcheon is mounted on an inside surface of the inner liner to cover the second vent aperture. The escutcheon has air flow passages that are in fluid communication with the second vent aperture. The finial and the escutcheon can be secured together within the first and second vent apertures. A plurality of bushings can be inserted to extend through the third apertures. Each of the bushings has an apertured face flange that engages the inside surface of the inner liner and covers a respective one of the third vent apertures. Each bushing has a central bore providing an air pathway through its respective third vent aperture.

BRIEF DESCRIPTION OF THE DRAWINGS

The objects, advantages and features of the present invention will be more clearly understood by reference to the following detailed disclosure and the accompanying drawing in which.

DETAILED DESCRIPTION OF THE PREFERRED EMBODIMENTS

Figure 1:
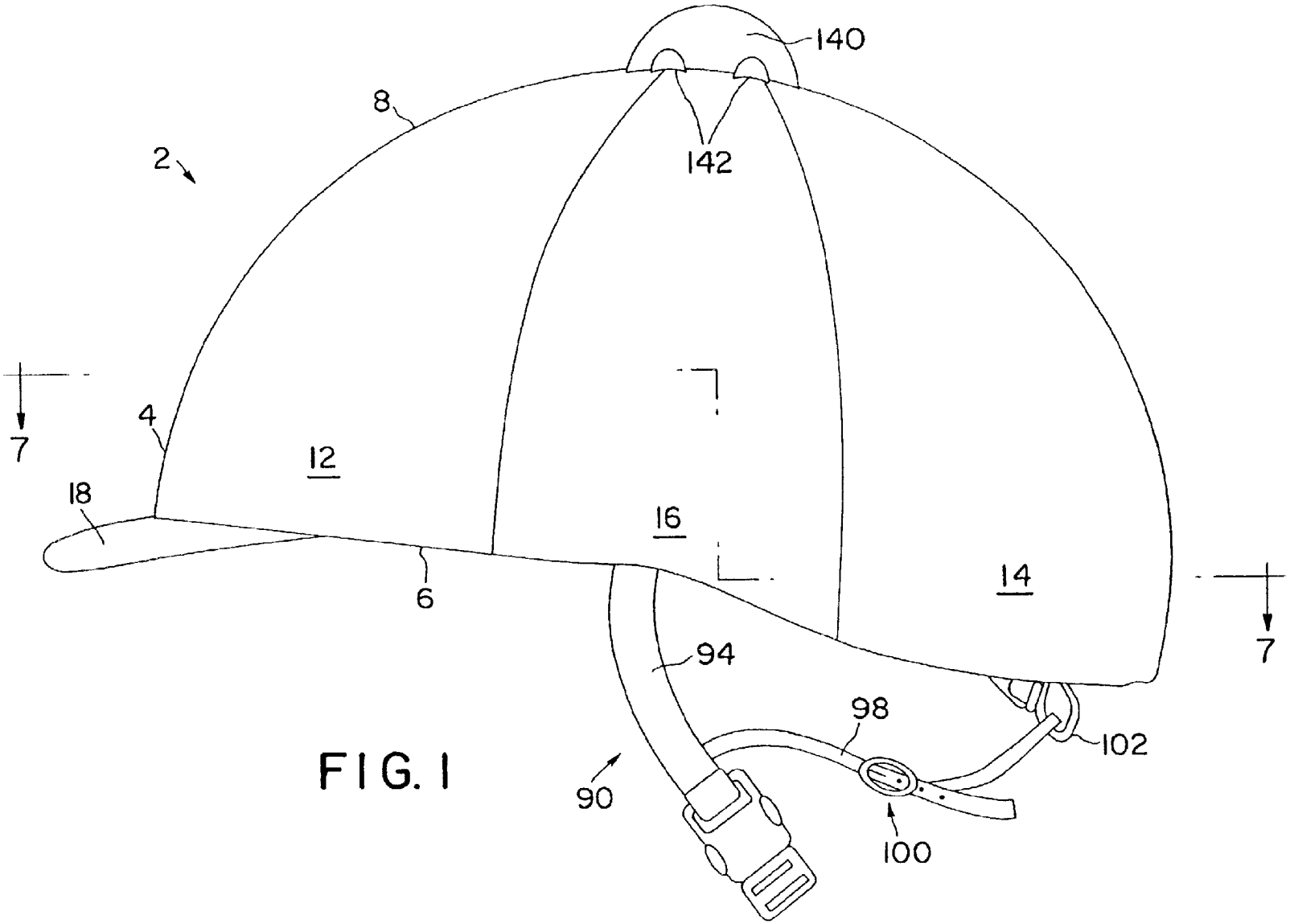
FIG. 1 is a side elevational view showing a headgear constructed in accordance a preferred embodiment of the present invention.
Figure 2:
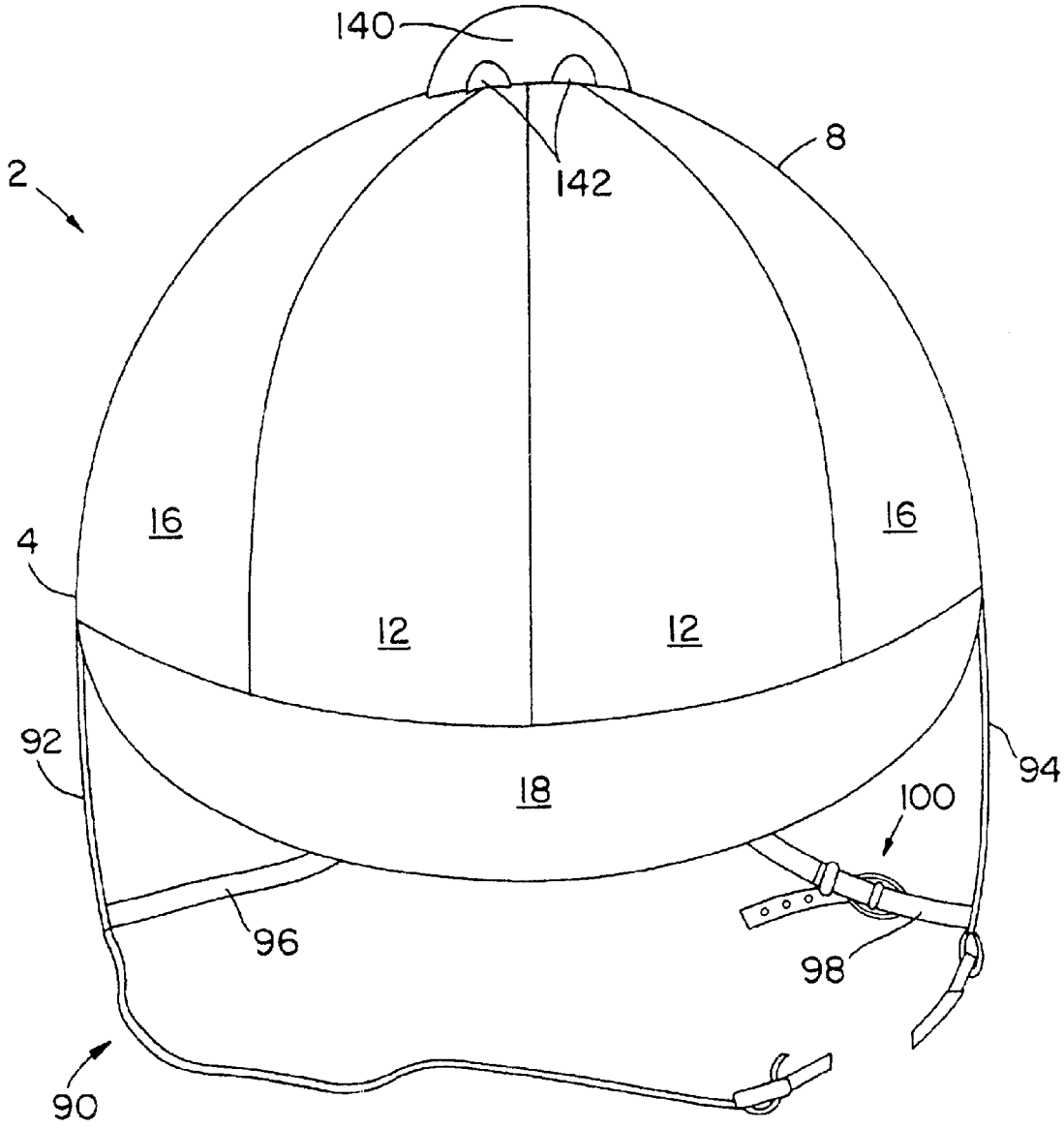
FIG. 2 is a front elevational view of the headgear of FIG. 1.
Figure 3:
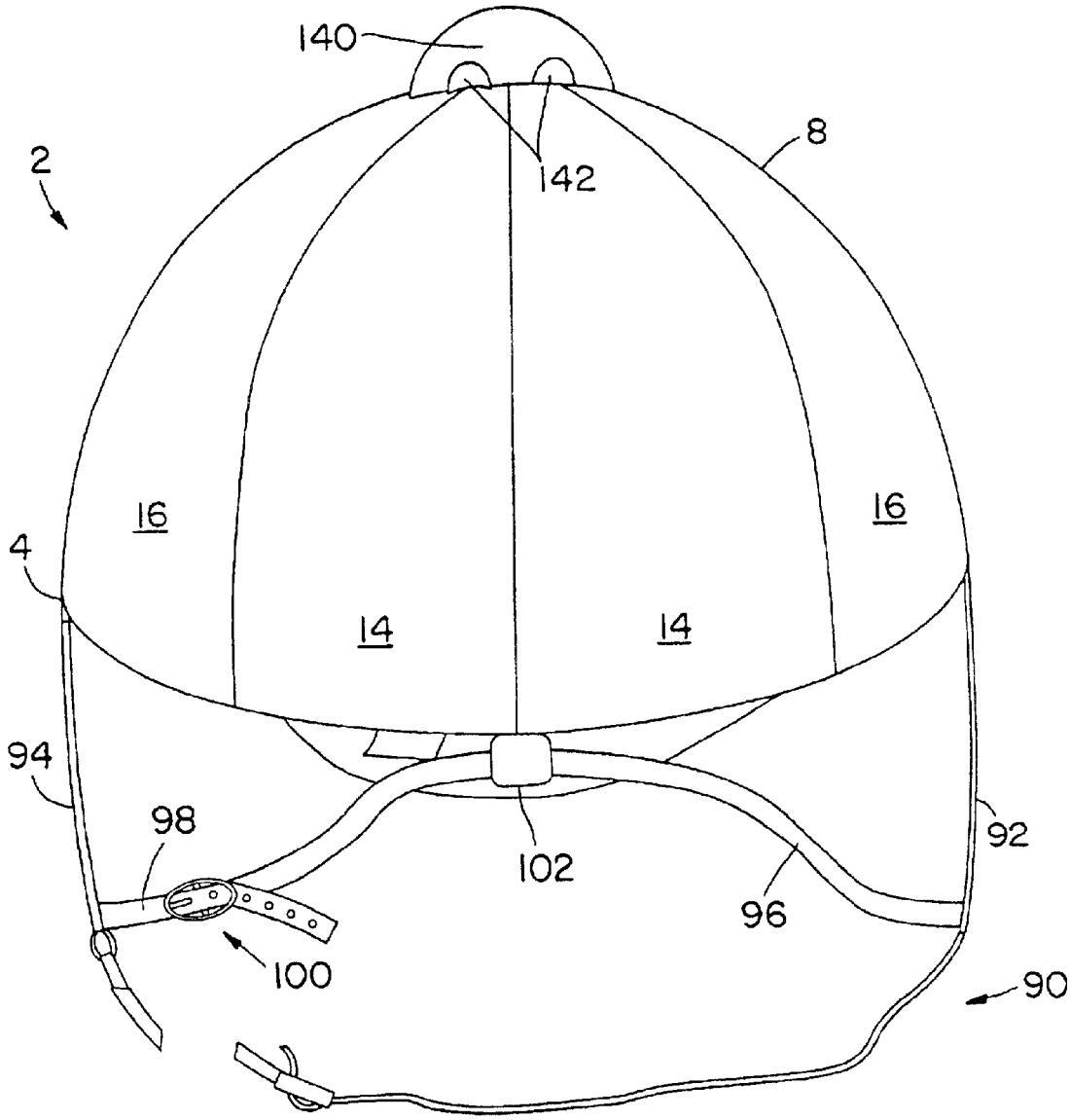
FIG. 3 is a rear elevational view of the headgear of FIG. 1.
Figure 4:
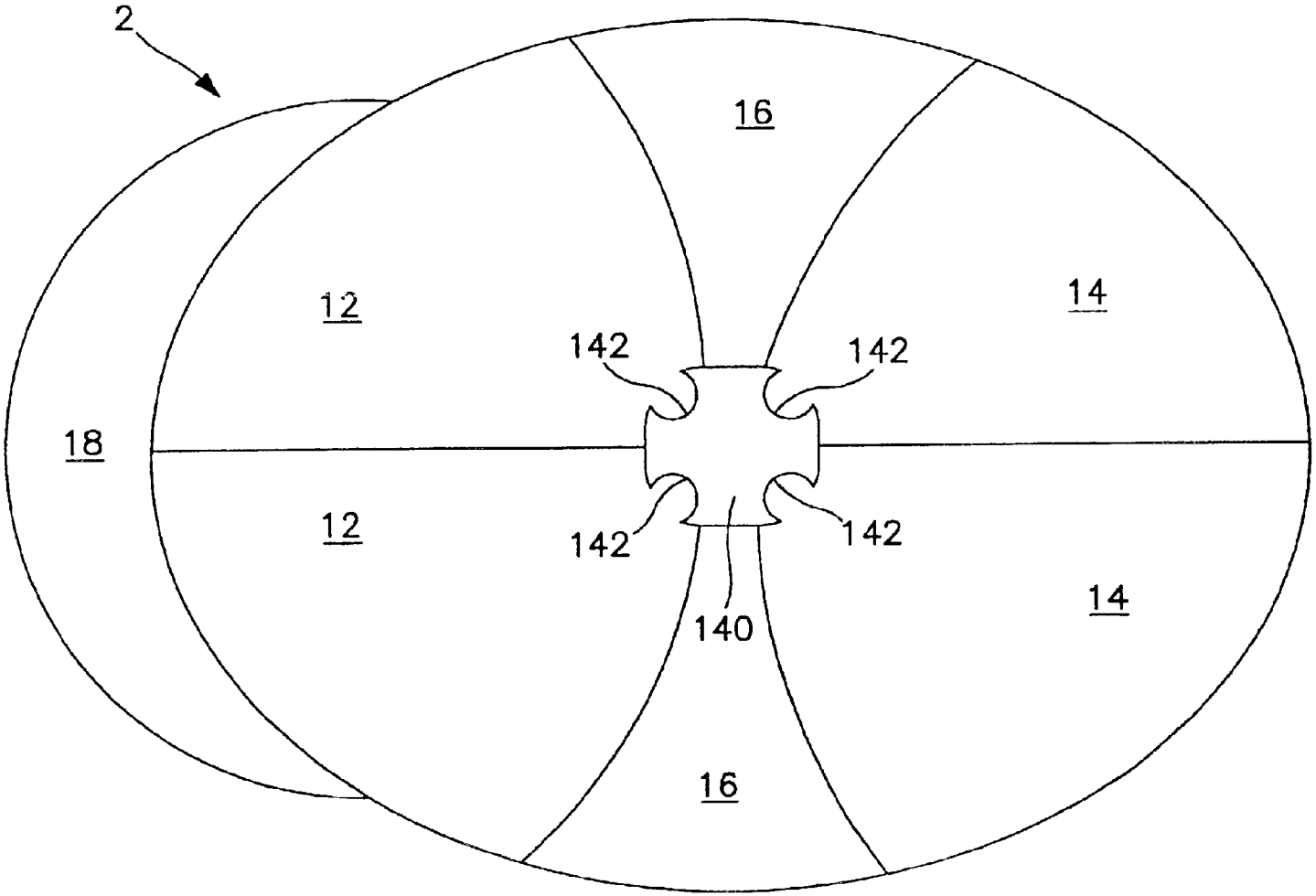
FIG. 4 is a top plan view of the headgear of FIG. 1.

Referring now to the drawing figures in which like reference numerals indicate like elements in all of the several views, FIGS. 1–4 illustrate a headgear 2 that is shaped and configured, by way of example only, to function as an equestrian show helmet. The headgear 2 includes an impact resistant outer shell 4 formed to cover a wearer's head and provide a tough, durable exterior surface of the headgear. The outer shell 4 has a continuous lower rim 6 and a hollow dome 8 extending from the lower rim 6 to a central crown 10. The lower rim 6 and the dome 8 collectively define a forward portion 12, a rearward portion 14, and lateral portions 16 of the outer shell. In the illustrated equestrian helmet configuration, the lower rim 6 extends along the bottom of the forward portion 12 of the outer shell 4, thence rearwardly along the bottom of the lateral side portions 16 of the outer shell, and thence further rearwardly and downwardly along the bottom of the rear portion 16 of the outer shell, wherein the rim 6 is at its lowest point. A brim 18 extends forwardly from the lower rim 6 at the forward portion 12 of the outer shell 4. The outer shell 4 may be formed using conventional molding techniques from materials such as acrylibutylstyrene (ABS) or the like, as is generally known.

Figure 10:
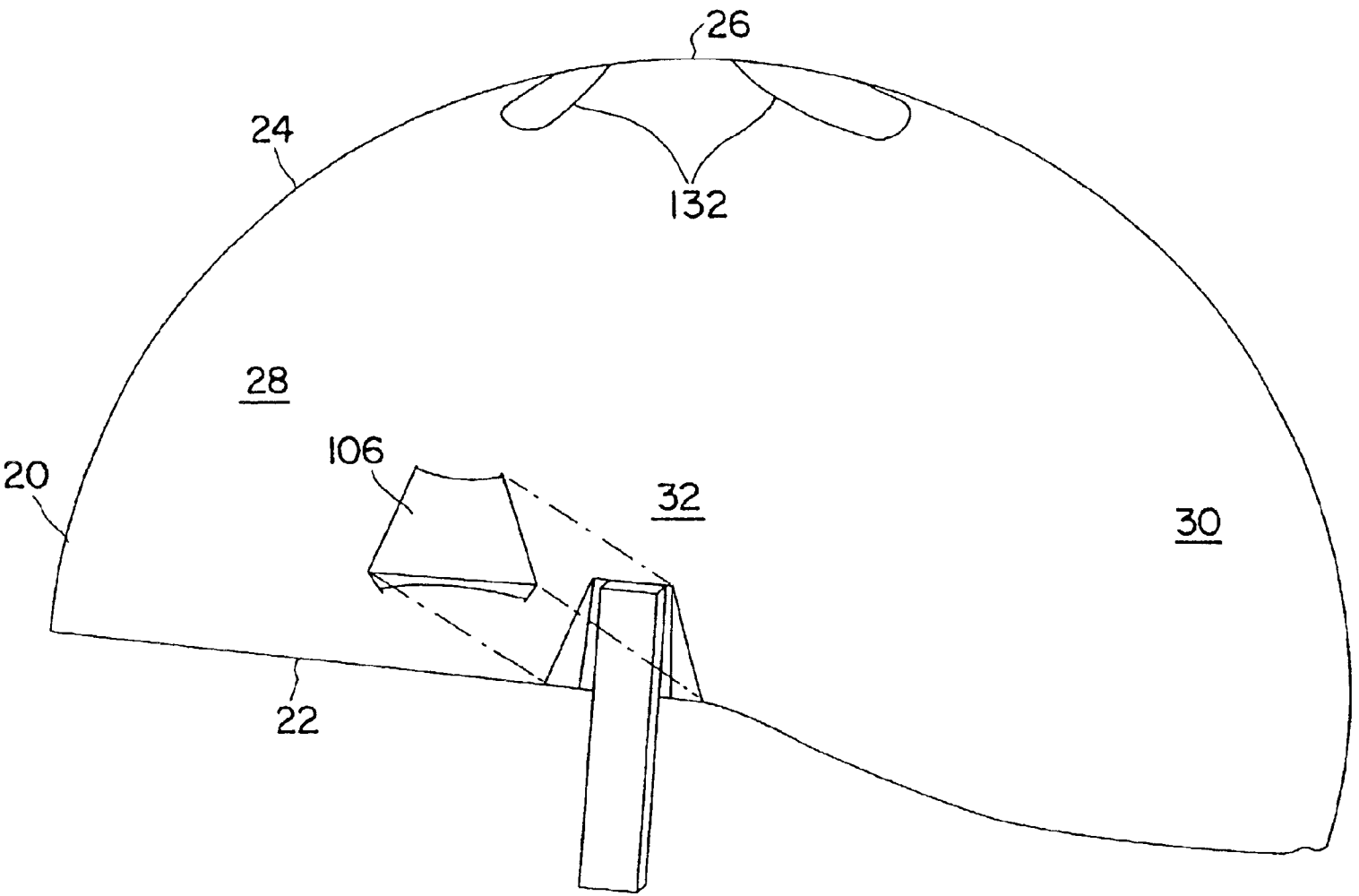
FIG. 10 is a side elevational view showing an inner liner of the headgear of FIG. 1.
Figure 11:
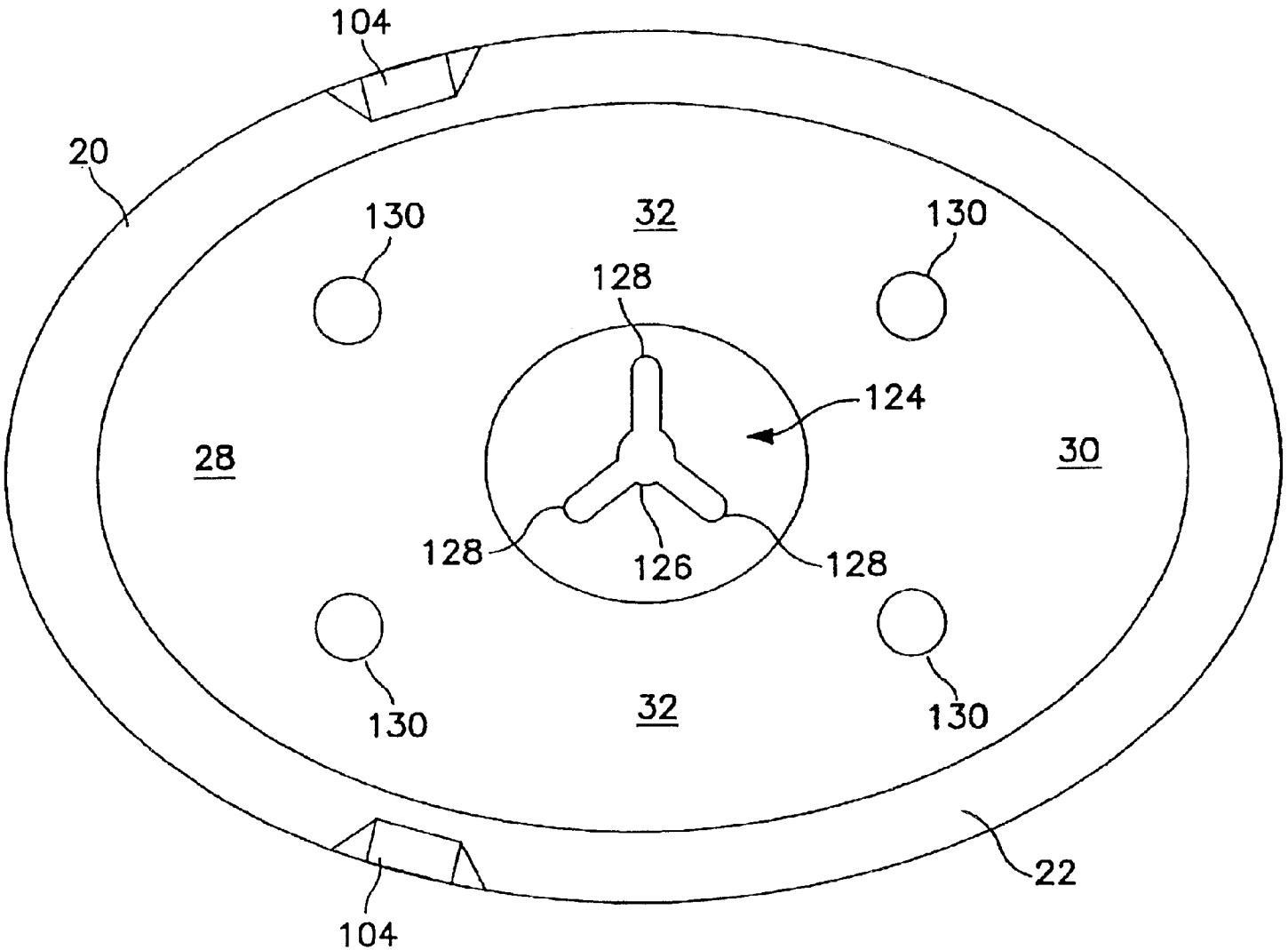
FIG. 11 is a bottom plan view of the inner liner of FIG. 8.
Figure 12:
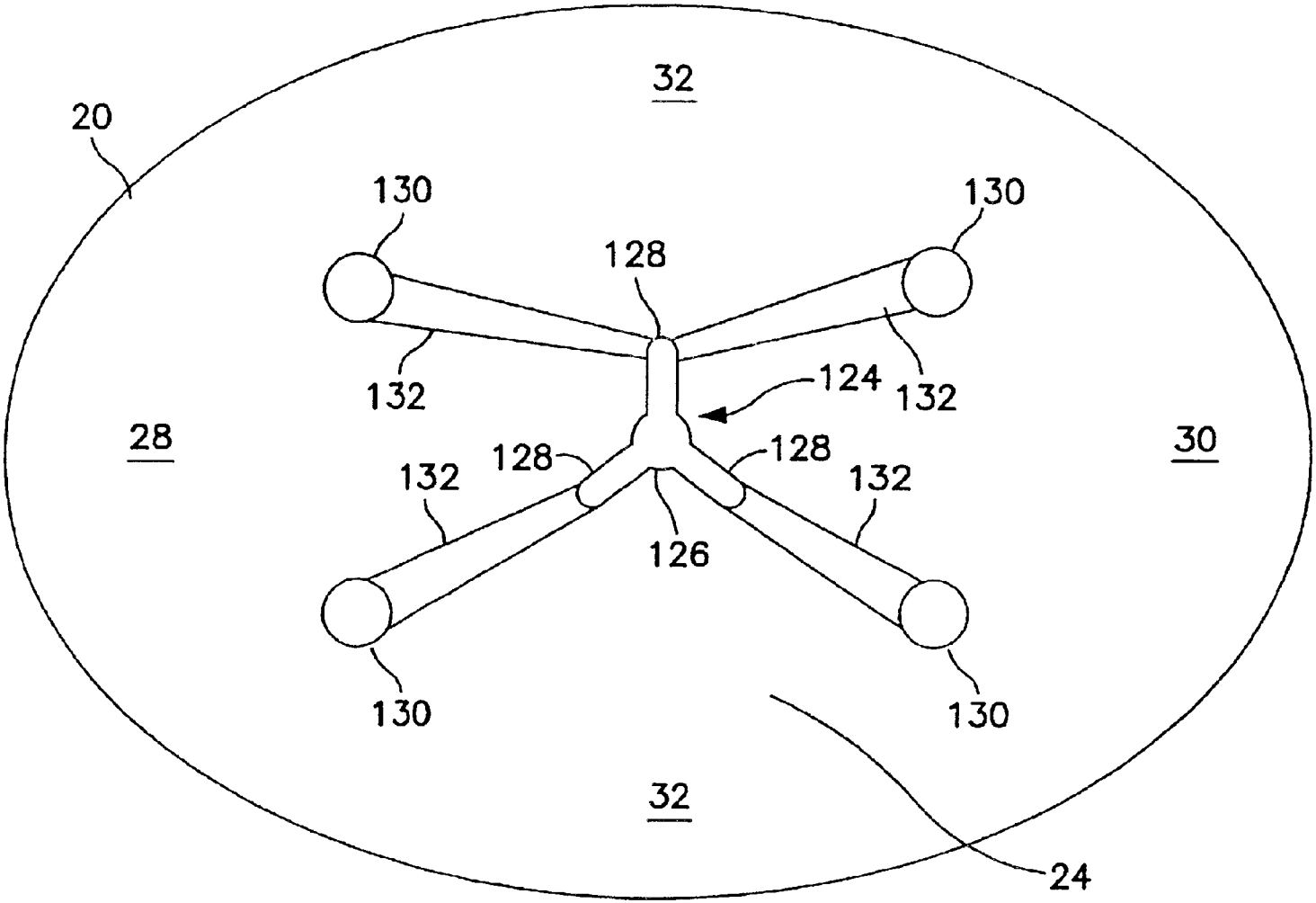
FIG. 12 is a top plan view of the inner liner of FIG. 8.

As shown in FIGS. 10–12, a protective inner liner 20 acts as a shock absorber for the headgear 2. It has a continuous lower rim 22 and a hollow dome 24 extending from the lower rim to a central crown 26 to provide a head receiving cavity. The lower rim 22 and the dome 24 collectively define a forward portion 28, a rearward portion 30, and lateral portions 32 of the inner liner. The dome 24 of the inner liner 20 is configured to nest within the dome 8 of the outer shell 4, in substantial engagement therewith. In this nested arrangement, the inner liner's lower rim 22 is located substantially proximate to the outer shell's lower rim 6 and preferably (but not necessarily) extends substantially coextensively therewith. The inner liner 20 may be formed using conventional molding techniques from materials such as expanded polystyrene (EPS) or the like, as is generally known. It can be secured within the outer shell using a suitable adhesive, such as epoxy or the like.

As mentioned by way of background above, the conventional approach to manufacturing protective headgear, such as helmets, is to produce many different sizes based on standard head forms in an effort to fit the headgear to a variety of human heads. Applicants have advanced the headgear fitting concept by determining how best to fit a wide range of head sizes and shapes with a limited number of headgear designs. As part of this effort, Applicants obtained length and width measurement data from over 1000 human heads and plotted the results. From these plots, Applicants determined that human heads tend to vary more in length than in width. Applicants found that the variance in human head width is small enough that only three (or possibly four) different headgear sizes are needed to accommodate the full range of normal head widths. To accommodate the much larger variance in human head length, applicants determined that the best approach is to make the headgear long enough to accommodate all lengths of heads but to provide a way to adjust the headgear in the lengthwise direction. The preferred solution is to provide a flexible headband whose length can be infinitely adjusted to fit all heads within the full range of normal head lengths. More specifically, applicants devised a headband system in which an adjustment at the rear of the headband pulls the headgear rearwardly when tightened, so that the front portion of the wearer's head fits snugly against the inside of the headgear, while the rear part of the head is encompassed by the adjusted headband. As a result, the entire circumference of the head is in contact with the headgear/headband to provide a secure fit. With this fitting method, the wearer chooses the headgear size that most accurately fits the width of the wearer's head, and then adjusts the headband to tighten the headgear in the lengthwise direction. It is immaterial whether the length of the headgear is appropriate for the wearer's head, because the lengthwise fitting is accomplished by the headband. As mentioned above, only three headgear sizes for any given headgear design/model are required. These three sizes can be fit snugly onto virtually every head size and shape within the normal head size range, including children's heads and large and unusually shaped adult heads.

Figure 6:
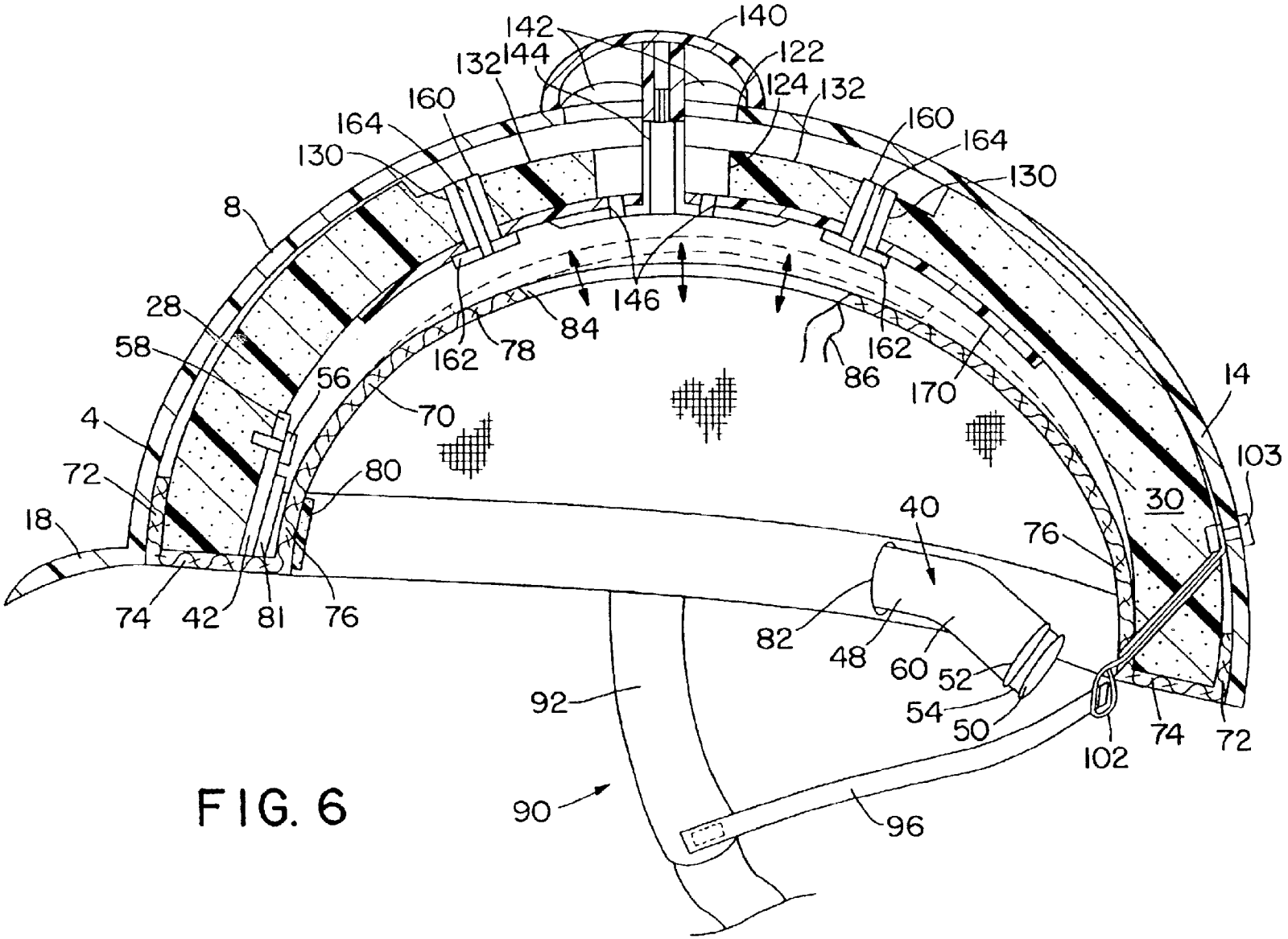
FIG. 6 is a cross-sectional view taken along line 6—6 in FIG. 5.
Figure 7:
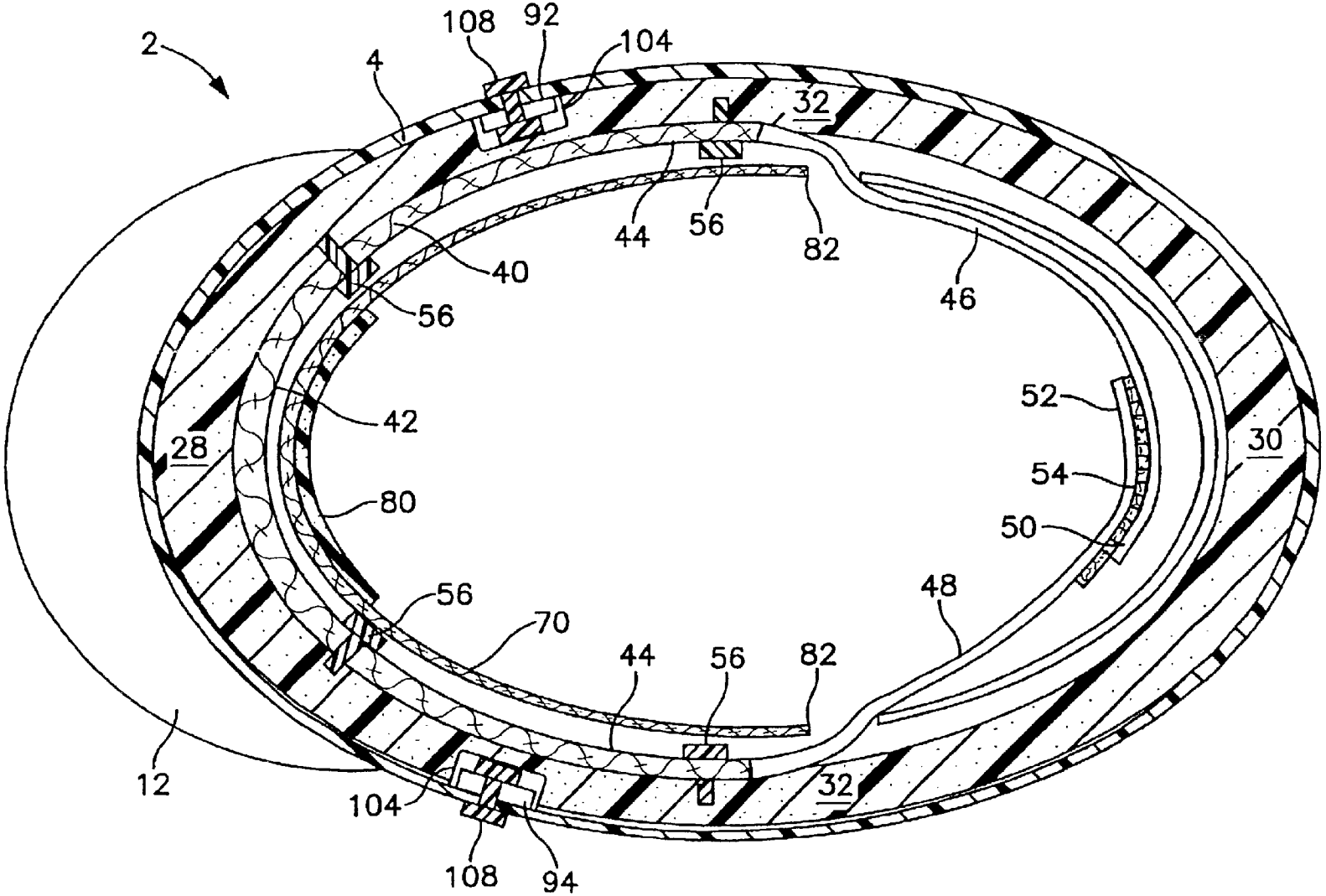
FIG. 7 is a cross-sectional view taken along line 7—7 in FIG. 1.
Figure 8:
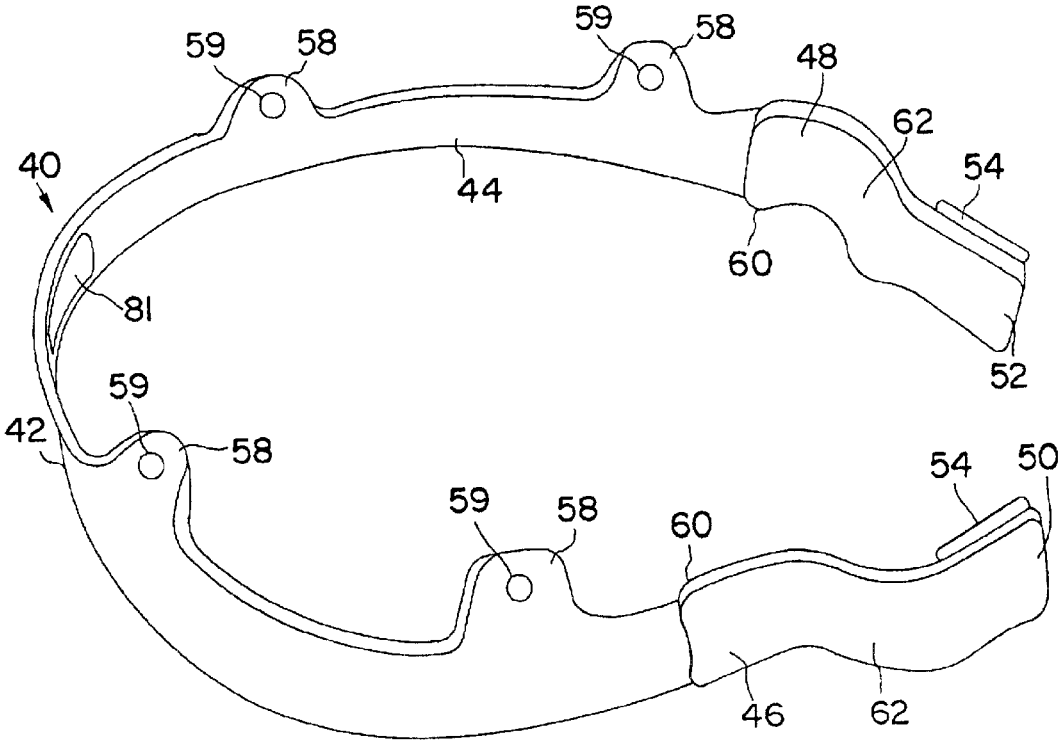
FIG. 8 is a perspective view of a headband used with the headgear of FIG. 1.

Turning now to FIGS. 5–9, a preferred headband 40 has a forward portion 42 and lateral portions 44 respectively secured to the inner liner forward and lateral portions 28 and 32. The headband 40 further includes a pair of flexible members 46 and 48, which are preferably straps, that extend rearwardly from the headband lateral portions 44. The flexible members 46 and 48 have respective free end portions 50 and 52 that are mutually interconnected via an adjustable locking mechanism that allows the headband 40 to accommodate heads of many different lengths. In its preferred embodiment, the locking mechanism comprises a hook and weave securement arrangement 54, the hook and weave components of which will be respectively mounted to the free end portions 50 and 52, as shown in FIG. 8.

Figure 9:
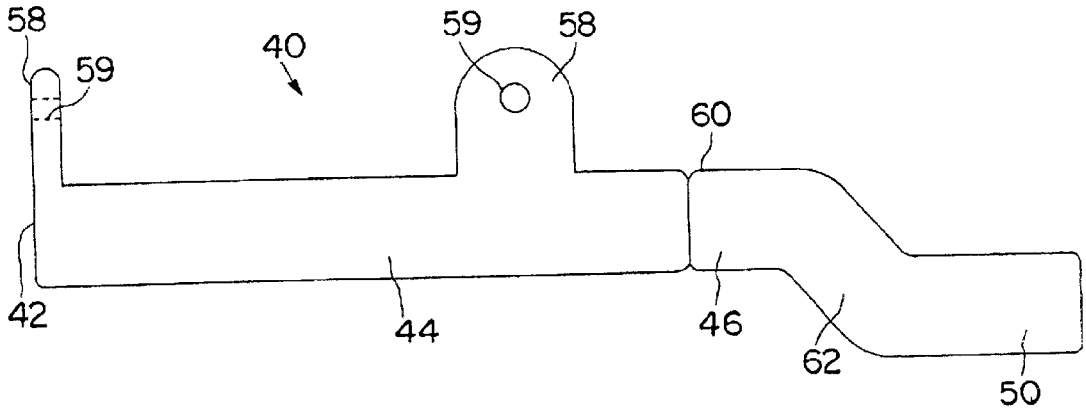
FIG. 9 is a side elevational view of the headband of FIG. 8.

As shown in FIG. 7, the forward and lateral portions 42 and 44 of the headband 40 are attached via connectors 56 to the inner liner 20. The connectors 56 can be formed out of plastic as threaded fasteners, or as ribbed "Christmas Tree" fasteners. As shown in FIGS. 6 and 8–9, the connecters 56 extend through vertical tabs 58 of the headband 40, which are formed with holes 59 to receive the connectors. The headband 40 itself is preferably made from plastic material. Because the forward and lateral portions 42 and 44 of the headband 40 are hidden from view (see below), they need not be decoratively treated. In contrast, the flexible members 46 and 48 are exposed to view and thus are preferably covered with a fabric material 60, as best shown in FIGS. 8 and 9. As further shown in FIGS. 8 and 9, the flexible members 42 and 44 further include a downwardly angled bend 62 that positions the free end portions 50 and 52 low on the back of a wearers head, near the nape of the neck. As can be seen in FIG. 6, the flexible members 46 and 48 thus initially extend generally parallel to the inner liner lower rim 22, in spaced relationship with the inside surface of the inner liner 20. The flexible members 46 and 48 then angle downwardly at 62 and continue until they terminate out of and below the head-receiving cavity at the free end portions 50 and 52. When tightened, the headband 40 will thus exert a downward pulling force on the headgear 2.

Figure 5:
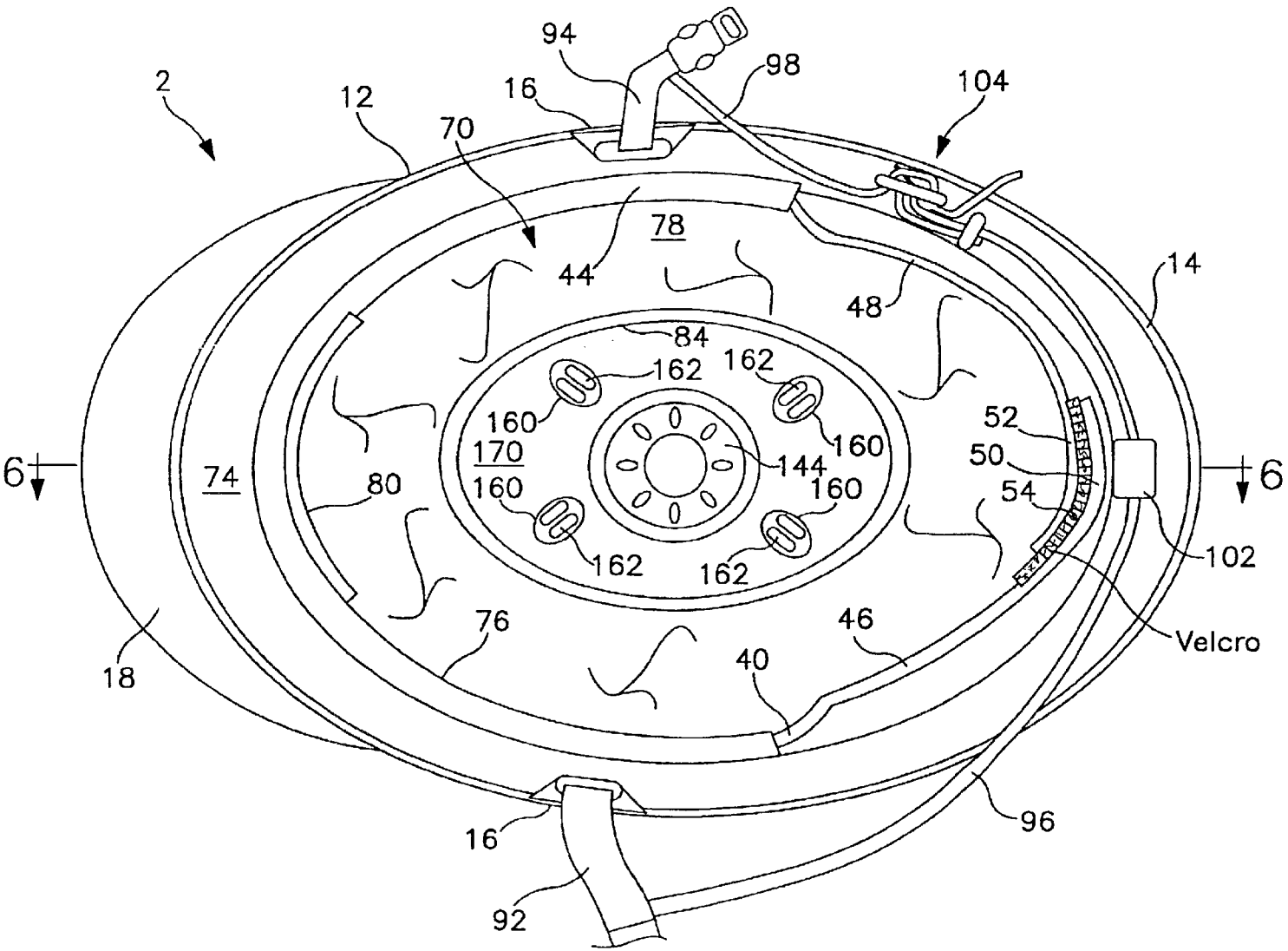
FIG. 5 is a bottom plan view of the headgear of FIG. 1.

As best shown in FIGS. 5–7, the headgear 6 further includes a fabric lining 70. Starting from its outermost peripheral edge, the fabric lining 70 has an attachment portion 72, a lower rim portion 74, a lower dome portion 76, and an upper dome portion 78. The portions 72–76 of the fabric lining 70 are preferably made from an absorbent fabric material, such as cotton. The upper dome portion 78 is preferably made from a decorative fabric material, such as silk or satin, and is designed to engage the top of a wearer's head. The attachment portion 72 (see FIG. 6) extends between the headgear outer shell 4 and the headgear inner lining 20, where it is secured using adhesive or the like. The lower rim portion 74 then wraps around the inner lining's lower rim 22. The lower dome portion 76 lies at the bottom of the head receiving cavity. Its forward and lateral portions cover the forward and lateral portions 42 and 44 of the headband 40. A perspiration absorber and cushioning pad ("pad") 80 made from fabric material or the like is preferably mounted on the forward portion of the lower dome portion 76 so as to cushion a wearer's forehead. If desired, an additional cushioning pad 81 made from resilient foam material or the like can be secured to the inside surface of the headband's forward portion 42, beneath the pad 80. Although the lower dome portion 76 covers the headband's forward and lateral portions 42 and 44, it does not cover the flexible members 46 and 48. Rather, the lower dome portion 76 is formed with a pair of slot openings 82 through which the headband flexible members 46 and 48 exit from behind the lining.

The upper dome portion 78 extends from the lower dome portion 76 toward the inner liner's crown 26. At the top of the upper dome portion 78 (which engages a wearer's head), the fabric liner 70 has an adjustable opening 84. The adjustable opening 84 facilitates vertical adjustment of the headgear 2. In particular, by changing the size of the adjustable opening 84, the vertical position of the top of the upper dome portion 78 can be adjusted relative to the inner liner's crown 26, as shown in FIG. 6. A larger opening allows more of a wearer's head to extend into the head-receiving cavity, thus lowering the headgear 2, while a smaller opening raises the headgear by allowing less of a wearer's head to enter the head-receiving cavity. In a preferred embodiment of the invention, the adjustable opening is formed with a drawstring 86 that surrounds the opening and allows the size thereof to be adjusted.

Referring now to FIGS. 1–3 and 6, a strap retention system 90 of the headgear 2 includes a pair of side retention straps 92 and 94 mounted to respective ones of the outer shell lateral portions 16 and extending downwardly therefrom. A pair of rear retention straps 96 and 98 respectively mount to the side retention straps 92 and 94. The rear retention straps 96 and 98 extend rearwardly from their points of attachment to the side retention straps and are secured together using an adjustable securement system, namely, a buckle 100. For positioning purposes, the rear strap 96 connects to the outer shell rearward portion 14 via a loop 102 that is attached to the outer shell rearward portion, as best shown in FIG. 6. In contrast to prior art retention systems described by way of background above, the adjustable buckle 100 is easy to use and will not change its position unless the buckle is unfastened and re-adjusted. Even then, it is a simple matter to determine the correct buckle position for each individual wearer, allowing the headgear 2 to be shared by several individuals.

As shown in FIG. 10, and in contrast to prior art retention systems, the inner liner lateral portions 32 are preferably formed with channels 104 in their respective outer surfaces that receive the lateral retention straps 92 and 94 and allow them to drape down in close proximity to a wearer's temples and cheeks. There are two advantages to this arrangement. First, the closeness of the side retention straps 92 and 94 to the wearer's face is more aesthetically pleasing than the greater separation between face and strap on other headgear. Second, overall headgear fit is improved by having the side retention straps 92 and 94 in contact or nearly in contact with the wearer's face, following its contours along its entire length.

As further shown in FIG. 10, a resilient insert 106 mounts over each lateral strap in a respective one of the channels 104. Each insert 106 is wedged between the outer shell 4 and the inner liner 20, such that it pushes its respective lateral strap inwardly toward the wearer's face. Conventional fasteners 108 are used to secure the lateral straps 92 and 94 within the channels 104.

Figure 13:
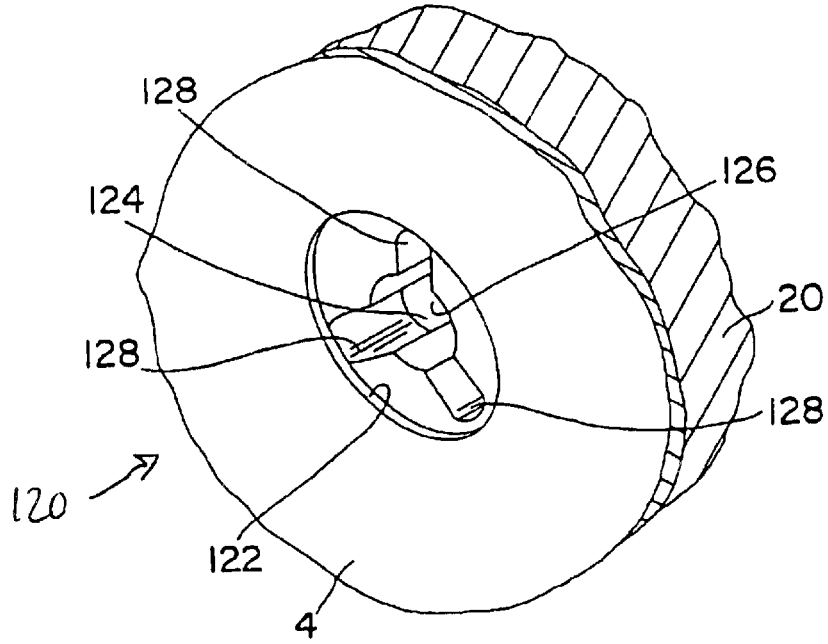
FIG. 13 is a partial perspective view taken from outside of the headgear of FIG. 1 and showing vent apertures respectively formed in the headgear's outer shell and inner liner.
Figure 14:
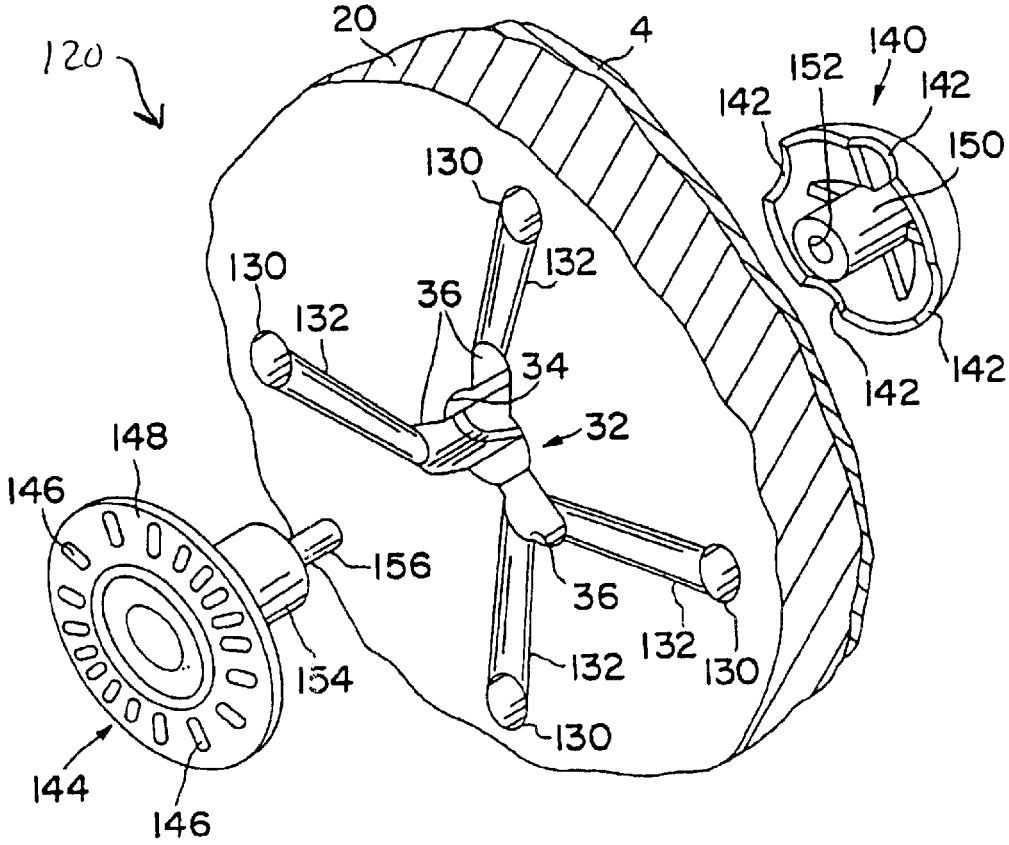
FIG. 14 is a partial perspective view taken from the inside of the headgear of FIG. 1 and showing an outer finial and an inner escutcheon positioned to extend through the vent apertures of FIG. 13.

Turning now to FIGS. 5–6, and with additional reference to FIGS. 13–14, the headgear 2 preferably includes a venting system 120. To provide the venting system 120, a first vent aperture 122 is formed in the outer shell's central crown 10, and a second vent aperture 124 is formed in the inner liner's central crown 26. The first and second vent apertures 122 and 124 are in fluid communication with each other to provide a primary pathway for air flow between the head-receiving cavity and ambient air outside of the headgear 2. As additionally shown in FIGS. 11–14, the second vent aperture 124 includes a central cylindrical bore 126 and a plurality of side vents 128. The venting system 120 also includes a plurality of third vent apertures 130 that are formed in the inner liner 20, near its central crown 26, in spaced relationship with the second vent aperture 124. As shown in FIGS. 10 and 12, a plurality of grooves 132 are also formed in the outer surface of the inner liner 20. Each of the grooves 132 respectively extends from one of the third vent apertures 130 to the second vent aperture 124. Via the grooves 132, the third vent apertures 130 are placed in fluid communication with the second vent aperture 124 to provide secondary pathways for air flow between the head-receiving cavity and ambient air outside of the headgear. Thus, hot air from several areas within the head-receiving cavity (not just the crown as in the above-referenced '004 patent) is channeled outwardly through the primary and secondary pathways. Outside air blowing across the outer surface of the headgear 2 serves to pull the hot air through these pathways, providing cooling to the wearer's scalp.

To provide ventilation without disturbing the smooth exterior appearance of the headgear 2, which is important for equestrian helmets, the venting system 120 may further include an outer finial 140 that can be shaped to have a raised button-like appearance. The outer finial 140 is mounted on top of the outer shell 4 to cover the first vent aperture 122. The finial 140 has arched air flow passages 142 that are formed therein in fluid communication with the first vent aperture 122. The headgear 2 may further include an inner escutcheon 144 mounted on the inside of the inner liner 20 to cover the second vent aperture 124. The escutcheon 144 has plural air flow passages 146 formed in a disk-shaped flange portion 148 thereof. The air flow passages 146 are in fluid communication with the second vent aperture 124. The finial 140 and the escutcheon 144 can be secured together within the first and second vent apertures 122 and 124. They are preferably connected in the manner described in the above-referenced '004 patent. Thus, as shown in FIG. 14 herein, the finial 140 has a central mounting stem 150 with a central bore 152. The escutcheon 144 has a central base stem 154 extending from the flange portion 148. The base stem 154 is sized to be snugly received in the central bore 126 of the second vent aperture 124. The escutcheon 144 further has a secondary stem 156 extending from the base stem 154. The secondary stem 156 is designed to be received within the hollow bore 152 of the finial stem 150. A suitable adhesive is used to bond these components together. Although not shown, a plurality of longitudinal grooves can be formed along surface of the hollow bore 152 to allow excess adhesive to collect. In addition, the secondary stem 156 may be provided with a central through-hole to allow air to escape during assembly when the escutcheon is mounted thereon, and to speed drying of the adhesive.

As shown in FIGS. 5 and 6, a plurality of bushings 160 extend through the third vent apertures. For decorative purposes, each of the bushings 160 has an apertured face flange 162 mounted to engage the inside surface of the inner liner 20 and to cover an associated one of the third vent apertures 130. A central bore 164 in each bushing 160 provides an air passage through its associated third vent aperture.

To further provide a decorative appearance for the headgear 2, an upper silk or satin lining 170 can be mounted to the inside surface of the inner liner 20, at the upper dome portion 26 thereof as shown in FIGS. 5 and 6. The lining 170 is mounted to the inner liner 20 using a suitable adhesive. It extends under the flange portion 148 of the escutcheon 144, and under the face flanges 162 of the bushings 160. If the headgear 2 is an equestrian helmet, a final decorative treatment could include covering the outer shell 4, the brim 18 and the finial 140 with velvet or a velvet-like decorative material (not shown). A decorative ribbon (not shown) could also be mounted to the outer shell's rearward portion 14, as is generally known.

Accordingly, an improved headgear, and particularly an equestrian helmet adapted to be worn by riders for equestrian events, has been disclosed. While preferred embodiments of the invention has been shown and described, it should be apparent that many variations and alternative embodiments would be apparent to those skilled in the art in view of the teachings herein. It is understood, therefore, that the invention is not to be in any way limited except in accordance with the spirit of the appended claims and their equivalents.

We claim:

1. A headgear, comprising:

an outer shell having a continuous lower rim and a hollow dome extending from said lower rim to a central crown, said lower rim and dome collectively defining a forward portion, a rearward portion, and lateral portions of said outer shell;

an inner liner nested in the dome of said outer shell, said inner liner having a continuous lower rim and a hollow dome extending from said lower rim to a central crown to provide a head receiving cavity, said lower rim and said dome collectively defining a forward portion, a rearward portion, and lateral portions of said inner liner;

a headband, said headband having a forward portion and lateral portions respectively secured to said inner liner forward and lateral portions, and further including a rearward portion extending rearwardly from said headband lateral portions;

a venting system, said venting system including:

a first vent aperture formed in said crown of said outer shell;

a second vent aperture formed in said crown of said inner liner; and said first and second vent apertures being in fluid communication with each other to provide a primary pathway for air flow between said head-receiving cavity and ambient air outside of said headgear;

a plurality of third vent apertures formed in said inner liner in spaced relationship with said second vent apertures; and wherein said venting system further includes an outer finial retained on said outer shell to cover said first vent aperture, said finial having a raised button-shaped appearance and air flow passages that are in fluid communication with said first aperture.

2. A headgear in accordance with claim 1 wherein said third vent apertures are in fluid communication with said first and second vent apertures.

3. A headgear in accordance with claim 1 wherein said third vent apertures are elongated.

4. A headgear in accordance with claim 1 wherein some of said third vent apertures are situated on said forward portion of said inner liner and other of said third vent apertures are situated on said rearward portion of said inner liner.

5. A headgear in accordance with claim 1 wherein at least a portion of each of said third vent apertures extends completely through said inner liner.

6. A headgear in accordance with claim 1 wherein said third vent apertures comprise elongated channels and holes extending through said inner liner.

7. A headgear in accordance with claim 1 wherein there are four of said third vent apertures.

8. A headgear in accordance with claim 1 further including a fabric inner lining, said lining having at least one opening therein in fluid communication with said third vent apertures.

9. A headgear in accordance with claim 1 further including an inner escutcheon located on an inner side of said outer shell and having air flow passages in fluid communication with said first and second apertures, said finial and said escutcheon being secured together such that said finial is retained on said headgear by said escutcheon.

10. A headgear shaped as an equestrian riding helmet, said headgear having an air vent system, comprising:

a central aperture system formed in said headgear at a central uppermost portion thereof, said central aperture system including inner and outer central aperture portions respectively associated with inner and outer sides of said helmet; and a peripheral aperture system associated with said inner side of said helmet and in spaced relationship with said central aperture system; and wherein said vent system further includes an outer finial associated with said outer side of said headgear, said finial having a raised button-shaped appearance and air flow passages that are in fluid communication with said central aperture system.

11. A headgear in accordance with claim 10 wherein said peripheral aperture system is in fluid communication with said central aperture system.

12. A headgear in accordance with claim 10 wherein said peripheral aperture system comprises elongated apertures.

13. A headgear in accordance with claim 10 wherein said peripheral aperture system comprises first vent apertures associated with a forward portion of said headgear and second vent apertures associated with a rearward portion of said headgear.

14. A headgear in accordance with claim 10 wherein said peripheral aperture system comprises apertures formed as elongated channels and holes.

15. A headgear in accordance with claim 10 wherein there said peripheral aperture system comprises four vent apertures.

16. A headgear in accordance with claim 10 further including a fabric inner lining, said lining having at least one opening therein in fluid communication with said peripheral aperture system.

17. A headgear in accordance with claim 10 further including an inner escutcheon associated with an inner side of said headgear and having air flow passages in fluid communication with said central aperture system, said finial and said escutcheon being secured together such that said finial is retained on said headgear by said escutcheon.

18. A headgear, shaped as an equestrian riding helmet, said headgear having an air vent system, comprising:

a central aperture system formed in said headgear at a central uppermost portion thereof;

a peripheral aperture system formed in said headgear in spaced relationship with said central aperture system;

an escutcheon associated with an inner side of said headgear;

a finial associated with an outer side of said headgear and secured to said escutcheon; and said escutcheon and said finial each including vented portions extending in said central aperture system.

* * * * *